US010490373B2

(12) United States Patent
Yuan et al.

(10) Patent No.: US 10,490,373 B2
(45) Date of Patent: Nov. 26, 2019

(54) KEY WITH BALANCE RODS AND KEYBOARD

(71) Applicants: Jian-Ping Yuan, Guangdong (CN); Hui-Hu Liang, Sioushuei Township, Changhua County (CN)

(72) Inventors: Jian-Ping Yuan, Guangdong (CN); Hui-Hu Liang, Sioushuei Township, Changhua County (CN)

( * ) Notice: Subject to any disclaimer, the term of this patent is extended or adjusted under 35 U.S.C. 154(b) by 147 days.

(21) Appl. No.: 15/772,750

(22) PCT Filed: Oct. 26, 2015

(86) PCT No.: PCT/CN2015/092807
§ 371 (c)(1),
(2) Date: May 1, 2018

(87) PCT Pub. No.: WO2017/035932
PCT Pub. Date: Mar. 9, 2017

(65) Prior Publication Data

US 2018/0323024 A1 Nov. 8, 2018

(30) Foreign Application Priority Data

Sep. 2, 2015 (CN) ..... 2015 2 0678299 U

(51) Int. Cl.
*H01H 9/00* (2006.01)
*H01H 36/00* (2006.01)

(52) U.S. Cl.
CPC ... *H01H 36/0073* (2013.01); *H01H 2221/058* (2013.01); *H01H 2227/036* (2013.01); *H01H 2233/03* (2013.01); *H01H 2233/07* (2013.01)

(58) Field of Classification Search
CPC ..... H01H 2227/036; H01H 2233/03; H01H 2233/07; H01H 369/0073
(Continued)

(56) References Cited

U.S. PATENT DOCUMENTS

2008/0308397 A1* 12/2008 Chou ..... H01H 13/705 200/5 A
2009/0000932 A1* 1/2009 Hosokawa ..... H01H 13/12 200/344
2010/0231518 A1* 9/2010 Chen ..... G06F 3/0202 345/168

FOREIGN PATENT DOCUMENTS

CN 202189709 A 4/2012
CN 202523584 U 11/2012
(Continued)

OTHER PUBLICATIONS

International Search Report in corresponding Application No. PCT/CN2015/092807, dated May 20, 2016.

*Primary Examiner* — Alexander Talpalatski
(74) *Attorney, Agent, or Firm* — Muncy, Geissler, Olds & Lowe, P.C.

(57) ABSTRACT

A key with balance rods and a keyboard are provided. The key includes a base plate. A sensing component is disposed on the base plate. An intermediate plate is disposed on the sensing component. The intermediate plate has a key hole and a receiving chamber which penetrate upper and lower surfaces of the intermediate plate. A keying portion is disposed on the base plate. Balance rods are disposed between a lower surface of the keying portion and a lower surface of the intermediate plate or base plate. Two balance rods run in the direction of X-axis or the direction of Y-axis, whereas one balance rod runs in the other direction and between the two balance rods. The three balance rods neither cross nor overlap. The key with balance rods and the keyboard have a comfortable feel and are applicable to laptops with thin keyboards, tablets, and smartphone keyboards.

12 Claims, 7 Drawing Sheets

(58) Field of Classification Search
USPC ..... 335/207
See application file for complete search history.

(56) References Cited

FOREIGN PATENT DOCUMENTS

| | | | |
|---|---|---|---|
| CN | 202601435 | U | 12/2012 |
| CN | 103021712 | A | 4/2013 |
| CN | 103065846 | A | 4/2013 |
| CN | 104377065 | A | 2/2015 |
| CN | 205122406 | U | 3/2016 |
| DE | 102012015133 | A1 | 5/2013 |

* cited by examiner

KEY WITH BALANCE RODS AND KEYBOARD

BACKGROUND OF THE INVENTION

1. Technical Field

The present disclosure relates to the field of computer input devices and, more particularly, to a key with balance rods, and a keyboard.

2. Description of Related Art

Nowadays keyboards are the most frequently-used and important input devices. With consumer electronics becoming lighter and thinner, keyboards are developed toward the trend of being increasingly light and thin. To this end, thin-film keyboards, magnetically-driven keyboards, and magnetic keyboards are devised.

China patent CN202601435 discloses a keyboard composed of magnetic keys. The magnetic keys each include a keycap, a support plate, a switch component, and a frame.

China patent CN103065846 discloses a magnetically-driven key and a keyboard. The magnetically-driven key includes a base plate, a support unit, a first magnetically-driven unit, a keycap, and a second magnetically-driven unit.

The prior art also discloses thin-film keyboards of different structures and magnetic keyboards of different structures.

The operating principle of the magnetic keyboards is based on mutual acting forces of two magnets or attraction between a magnet and a metallic iron plate. The operating principle varies from magnetic key to magnetic key, and the same applies to keyboards.

In order for any sort of thin-film keyboards and magnetic keyboards to be thinner and practicable, their feel must be enhanced so that they catch up with or surpass existing keyboards of laptops in tactile experiences for users.

The aforesaid tactile experiences hinge on the amount of force exerted by users in order to work with the keys and how the keys come into equilibrium.

A guide post, scissor mechanism, balance rod, and butterfly mechanism, each of which is mounted in place below a keying portion, are effective in achieving key equilibrium and well known among persons skilled in the art related to keyboards.

Therefore, it is important to render thin-film keyboards and magnetic keyboards thinner and improve their key equilibrium in order for them to be practicable.

BRIEF SUMMARY OF THE INVENTION

In view of the aforesaid drawbacks of the prior art, the present disclosure provides a key with balance rods in order to balance a keying portion of a keyboard and minimize the thickness of the keyboard.

The key with balance rods provided by the present disclosure comprises: a base plate; a sensing component optionally disposed on the base plate; an intermediate plate optionally disposed above the sensing component and having a key hole penetrating upper and lower surfaces of the intermediate plate; an elastomer disposed in the key hole of the intermediate plate; a keying portion movably disposed in the key hole of the intermediate plate and abutting against the elastomer; and at least two balance rods disposed below the keying portion and each having a segment movably disposed at the keying portion, wherein one of the at least two balance rods has another segment connected to the intermediate plate, and another one of the at least two balance rods has another segment disposed at the intermediate plate or the base plate, with the at least two balance rods neither crossing nor overlapping.

In some embodiments of the present disclosure, the elastomer is disposed on the sensing component or on a lower surface of the keying portion.

In some embodiments of the present disclosure, the balance rods are movably connected to the keying portion, and the balance rods are movably connected to the intermediate plate or the base plate.

In some embodiments of the present disclosure, the intermediate plate has a receiving chamber penetrating an upper surface and a lower surface of the intermediate plate, with a magnetic component disposed in the receiving chamber of the intermediate plate, a magnetized iron plate having an arm and a hand, the arm being disposed in the key hole of the intermediate plate, the arm having an end fixedly connected to a lower surface of the keying portion, the arm having another end extending to reach the magnetic component disposed in the receiving chamber of the intermediate plate and connect to the hand, the arm being made of a plastic material or a metallic material, and the hand being a magnetically permeable iron plate, wherein the magnetic component and the hand of the magnetized iron plate are attracted, and thereby attached, to each other whenever the arm is not pressed down under any external force.

In some embodiments of the present disclosure, the arm of the magnetized iron plate has a through hole penetrating upper and lower surfaces of the arm.

In some embodiments of the present disclosure, the key with balance rods further comprises a light guide plate disposed below the intermediate plate or below the sensing component.

In some embodiments of the present disclosure, the key with balance rods further comprises an upper cover which is disposed on the intermediate plate and has a through hole corresponding in position to the key hole.

In some embodiments of the present disclosure, a keyboard with balance rods comprises the key with balance rods.

In some embodiments of the present disclosure, the key hole is a through hole which is quadrilateral, polygonal or round.

Preferably, the receiving chamber of the intermediate plate is in the number of one or in a plural number and is disposed at an edge of the key hole.

In some embodiments of the present disclosure, the intermediate plate is made of a plastic and formed by injection molding.

In some embodiments of the present disclosure, the light guide plate is disposed below the intermediate plate or below the sensing component to enhance efficiency of light emission.

The magnetic component is a permanent magnet.

In some embodiments of the present disclosure, the arm of the magnetized iron plate has a through hole which penetrates its upper and lower surfaces. The through hole may be of any size, depending on design needs. In the event of manufacturing light-emitting keyboards, the through hole on the arm will be enlarged so as to facilitate light penetration.

In some embodiments of the present disclosure, the keying portion is made of a soft material, a rigid material, or a combination thereof and thus can be made very thin.

In some embodiments of the present disclosure, the keying portion and the arm of the magnetized iron plate are integrated.

In some embodiments of the present disclosure, the keying portion is made of a transparent material to facilitate light penetration.

In some embodiments of the present disclosure, the balance rods are disposed between the keying portion and the base plate, with one balance rod running in the direction of X-axis and one balance rod running in the direction of Y-axis, that is, two balance rods in total, and the two balance rods neither cross nor overlap.

Preferably, the arm of the magnetized iron plate is in the number of one, but the hand is in the number of one or in a plural number.

In some embodiments of the present disclosure, the upper end of each balance rod is movably connected to the keying portion.

In some embodiments of the present disclosure, the lower end of each balance rod is movably connected to the intermediate plate or the base plate.

In the second aspect of the present disclosure, an embodiment provides a magnetic keyboard, comprising the plurality of magnetic keys.

In some embodiments of the present disclosure, the base plate of the plurality of magnetic keys of the keyboard is an integrally-formed integrated base plate. The sensing component of the plurality of magnetic keys of the keyboard is an integrally-formed integrated sensing component. The intermediate plate of the plurality of magnetic keys of the keyboard is an integrally-formed integrated intermediate plate. The light guide plate of the plurality of magnetic keys of the keyboard is an integrally-formed integrated light guide plate. The upper cover of the plurality of magnetic keys of the keyboard is an integrally-formed integrated upper cover.

The magnetic keyboard comprises an F function key, standard 1X keys, special keys, and a space bar.

Each standard 1X key has two balance rods 9 running in the direction of X-axis of the keying portion and one balance rod 10 running in the direction of Y-axis of the keying portion, that is, three balance rods in total. The three balance rods neither cross nor overlap.

The special keys include SHIFT key, CapsLock key, Tab key and/or Backspace key. Each special key has two balance rods running in the direction of X-axis of the keying portion and two balance rods running in the direction of Y-axis of the keying portion, that is, four balance rods in total. The four balance rods neither cross nor overlap.

An Enter key, one of the special keys, has three balance rods running in the direction of X-axis of the keying portion and four balance rods running in the direction of Y-axis of the keying portion, that is, seven balance rods in total. The seven balance rods neither cross nor overlap.

The space bar of the magnetic keyboard has two balance rods running in the direction of X-axis of the keying portion and four balance rods running in the direction of Y-axis of the keying portion, that is, six balance rods in total. The six balance rods neither cross nor overlap.

The flat or narrow F function key and UP, DOWN, LEFT, RIGHT keys of the magnetic keyboard have one balance rod 10 running in a flat direction of the keying portion, that is, one balance rod in total.

The upper end of each balance rod is movably connected to the keying portion.

The lower end of each balance rod is movably connected to the intermediate plate or the base plate.

In some embodiments of the present disclosure, each standard 1X key of the magnetic keyboard has one balance rod running in the direction of X-axis of the keying portion and one balance rod running in the direction of Y-axis of the keying portion, that is, two balance rods in total. The two balance rods neither cross nor overlap.

The balance rods are made of conventional stainless steel wires preferably of a diameter of 0.4-1.0 mm.

The keying portion region of the magnetic keyboard is individualized to meet customer needs. In some embodiments of the present disclosure, each standard 1X key of the keyboard has at least one balance rod running in the direction of X-axis and at least one balance rod running in the direction of Y-axis, with the balance rods not crossing or overlapping. In some embodiments of the present disclosure, the other keying portions of the keyboard either come with more balance rods or come with less balance rods, as appropriate, in order to operate in conjunction with the aforesaid magnetic key.

Advantages of the magnetic key and the keyboard in the aforesaid embodiments of the present disclosure are as follows:

(1) The balance rods are made of stainless steel wires and thus have sufficiently great mechanical strength and a sufficiently small diameter. Hence, the balance rods are effective in reducing the required thickness of the keys. More importantly, the balance rods improve the equilibrium of the keys, augment user experiences, and enable the keyboard comprising the magnetic keys to be practicable.

(2) Preferably, the upper cover is mounted on the intermediate plate to fix the magnetic component in place and thereby prevent the magnetic component from loosening and detaching from the receiving chamber of the intermediate plate. The upper cover mounted on the intermediate plate enables the keys to fit in the surroundings.

(3) Preferably, the light guide plate renders the magnetic keys applicable to light-emitting keyboards, improves conventional light emission technology, and enhances efficiency of light penetration. Therefore, the magnetic key and the keyboard in the aforesaid embodiments of the present disclosure are widely applicable to laptops.

BRIEF DESCRIPTION OF THE SEVERAL VIEWS OF THE DRAWINGS

To render the contents of the present disclosure comprehensible, the present disclosure is illustrated by specific embodiments and accompanying drawings and described below. The accompanying drawings are described briefly below.

DETAILED DESCRIPTION OF THE INVENTION

To render the objectives, technical solutions and advantages of the present disclosure clear and comprehensible, the present disclosure is illustrated by specific embodiments and accompanying drawings and described below.

Embodiment 1

Figure 1:
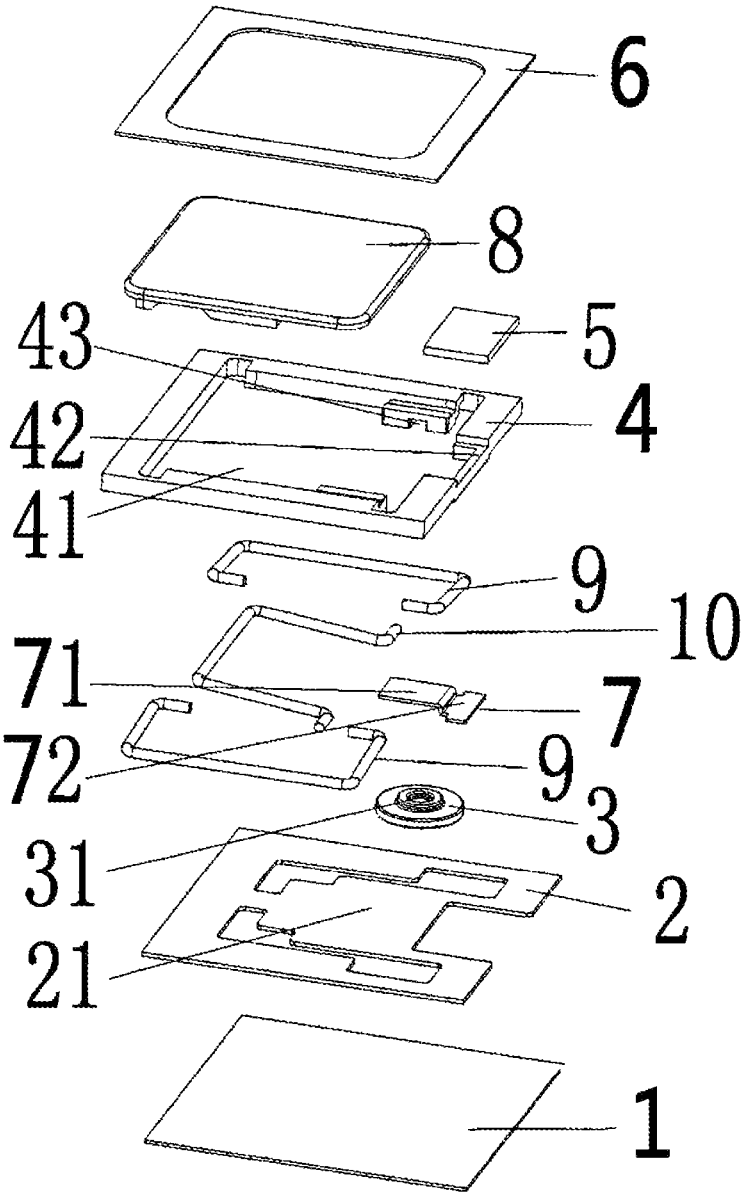
FIG. 1 is an exploded view of a magnetic key with balance rods according to embodiment 1.

FIG. 1 illustrates how balance rods are applicable to a standard 1X key of a magnetic keyboard in this embodiment. The key comprises a base plate 1, a sensing component 2, an elastomer 3, an intermediate plate 4, a magnetic component 5, an upper cover 6, a magnetized iron plate 7, a keying portion 8, a first balance rod 10, and a second balance rod 9.

The sensing component 2 has a thin-film circuit. The sensing component 2 is disposed on the base plate 1. The sensing component 2 further has a through hole 21 which penetrates upper and lower surfaces of the sensing component 2. The through hole 21 corresponds in position to the second balance rod 9 and the first balance rod 10.

The elastomer 3 is disposed on the sensing component 2 and has a bump 31 disposed in a key hole 41 of the intermediate plate 4. The height or structure of the elastomer 3 is adjustable, so as to adjust the feel of the key.

The intermediate plate 4 has upper and lower surfaces. The intermediate plate 4 is above the sensing component 2. The intermediate plate 4 has the key hole 41 and a receiving chamber 42 which penetrate the upper surface and the lower surface of the intermediate plate 4. The receiving chamber 42 is disposed at an edge of the key hole 41. The intermediate plate 4 is made of a plastic and formed by injection molding. A balance rod connection mechanism 43 is disposed on the lower surface of the intermediate plate 4.

In this embodiment, the magnetic component 5 is disposed in the receiving chamber 42 of the intermediate plate 4. Optionally, the upper cover 6, which is made of PET film, adheres to the upper surface of the intermediate plate 4 to further prevent the magnetic component 5 from loosening or detaching, thereby allowing the magnetic component 5 to fit inside the surroundings of the magnetic key.

The magnetized iron plate 7 comprises an arm 71 and a hand 72. The arm 71 is disposed in the key hole 41 of the intermediate plate 4 and firmly connected to the lower surface of the keying portion 8. The hand 72 is disposed between the lower surface of the magnetic component 5 and the base plate 1. The arm 71 extends to reach the bottom of the keying portion 8 so as to connect to the hand 72, thereby allowing the hand 72 to be disposed below the magnetic component 5. The hand 72 and the magnetic component 5 are attracted, and thereby attached, to each other whenever the arm 71 is not subjected to any external force.

The keying portion 8 is disposed on the magnetized iron plate 7 and firmly connected to the arm 71 of the magnetized iron plate 7. In this embodiment, the keying portion 8 is made of a plastic. A balance rod connection mechanism 81 is disposed on the lower surface of the keying portion 8, as shown in FIG. 2.

Figure 2:
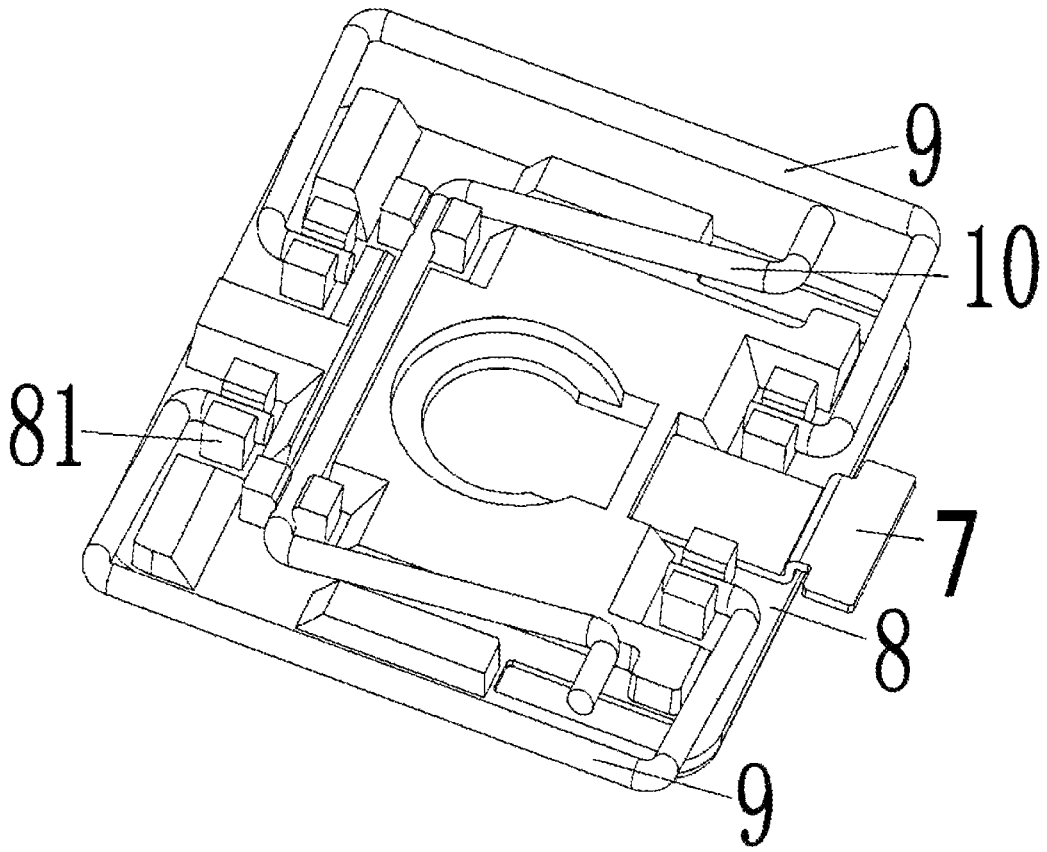
FIG. 2 is a schematic view of how to connect the balance rods to a keying portion according to embodiment 1.

Referring to FIG. 2, the second balance rod 9 is in the number of two, whereas the first balance rod 10 is in the number of one. The second balance rods 9 and the first balance rod 10 are disposed on the lower surface of the keying portion 8. Segments of the first and second balance rods 10, 9 are each movably connected to the connection mechanism 81 on the lower surface of the keying portion 8. The other segments of the first and second balance rods 10, 9 are each movably connected to the balance rod connection mechanism 43 of the intermediate plate 4. Optionally, a segment of at least one of the second balance rods 9, which is movably connected to the keying portion 8, is disposed on the inward side of the keying portion 8, whereas the other segment of the second balance rod 9, which is movably connected to the intermediate plate 4, is disposed on the outward side of the keying portion 8.

Figure 3:
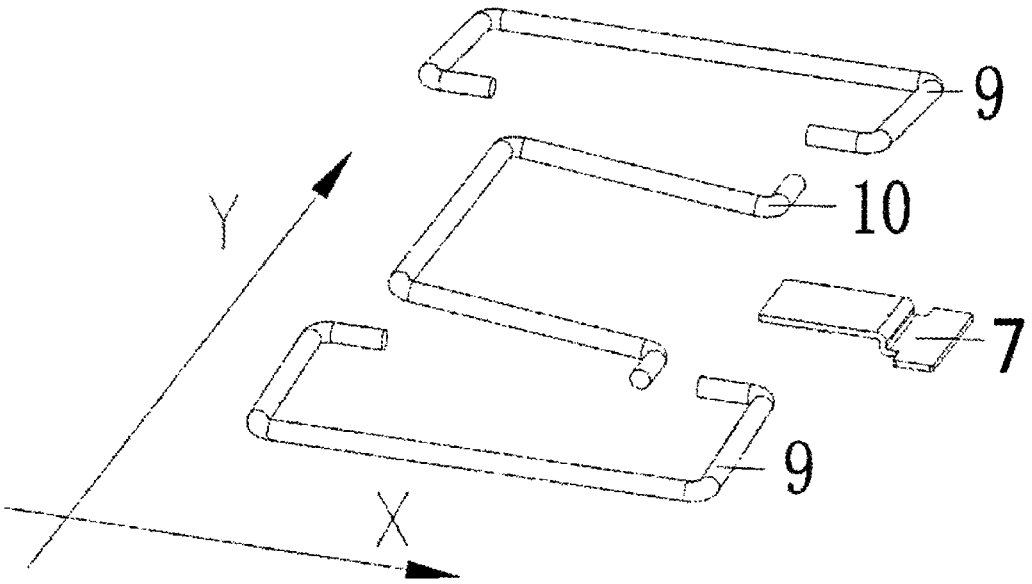
FIG. 3 is a schematic view which shows positions of the balance rods relative to each other according to embodiment 1.

Relative positions of the three balance rods 9, 10 of FIG. 2 are shown in FIG. 3. The two second balance rods 9 run in the direction of X-axis, whereas the first balance rod 10 runs in the direction of Y-axis. The three balance rods 9, 10 neither cross nor overlap.

This embodiment not only illustrates how the balance rods are applied to a standard 1X key of the magnetic keyboard, but also shows that the balance rods are each connected between the keying portion and the intermediate plate in variable ways.

Embodiment 2

In this embodiment, a magnetic key with balance rods comprises a base plate 1, a sensing component 2, an elastomer 3, an intermediate plate 4, a magnetic component 5, an upper cover 6, a magnetized iron plate 7, a keying portion 8, a balance rod 9, and a balance rod 10.

Figure 4:
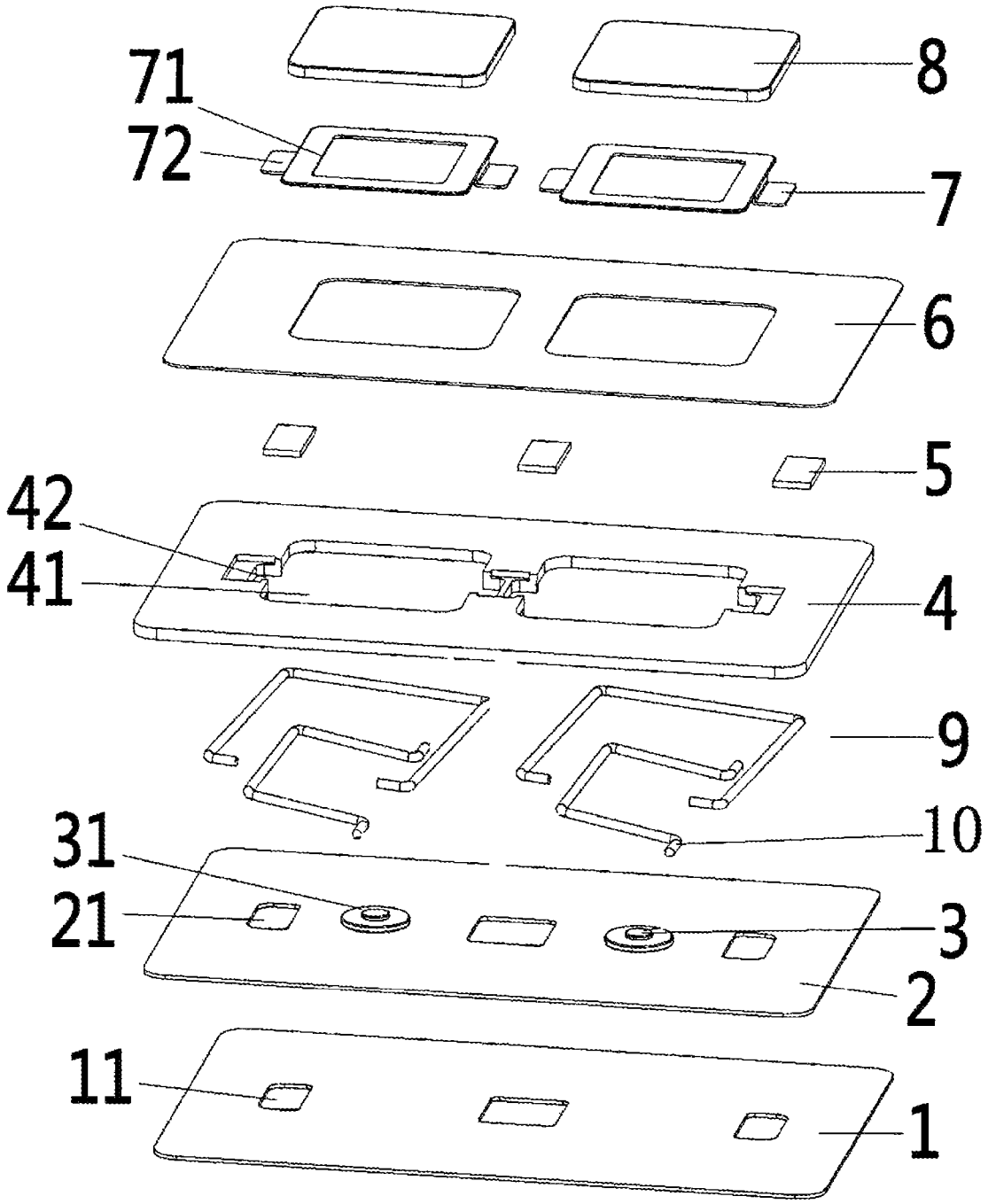
FIG. 4 is a schematic view of a magnetic key with balance rods according to embodiment 2 preferably.

This embodiment improves and supplements embodiment 1, as shown in FIG. 4.

The intermediate plate 4 in embodiment 1 has only one receiving chamber 42. By contrast, the intermediate plate 4 in embodiment 2 has two receiving chambers 42.

Only one magnetic component 5 is provided in embodiment 1. By contrast, two magnetic components 5 are provided in embodiment 2.

Embodiment 1 requires two balance rods 9 and one balance rod 10, that is, three balance rods in total. By contrast, embodiment 2 requires one balance rod 9 and one balance rod 10, that is, two balance rods in total.

In embodiment 1, the arm 71 of the magnetized iron plate 7 has no through hole but one hand 72. By contrast, in embodiment 2, the arm 71 of the magnetized iron plate 7 not only has a through hole which penetrates its upper and lower surfaces, but also has two hands 72.

Embodiment 3

In this embodiment, a magnetic keyboard with balance rods comprises a plurality of magnetic keys each having balance rods according to any one of embodiments 1, 2. Each magnetic key of the magnetic keyboard with balance rods comprises a base plate, a sensing component, an elastomer, an intermediate plate, a magnetic component, an upper cover, a magnetized iron plate, a keying portion, balance rods, and a light guide plate.

The base plate is an integrally-formed integrated base plate. The sensing component is an integrally-formed integrated sensing component. The intermediate plate is an integrally-formed integrated intermediate plate. The light guide plate is an integrally-formed integrated light guide plate. The upper cover is an integrally-formed integrated upper cover.

Figure 5:
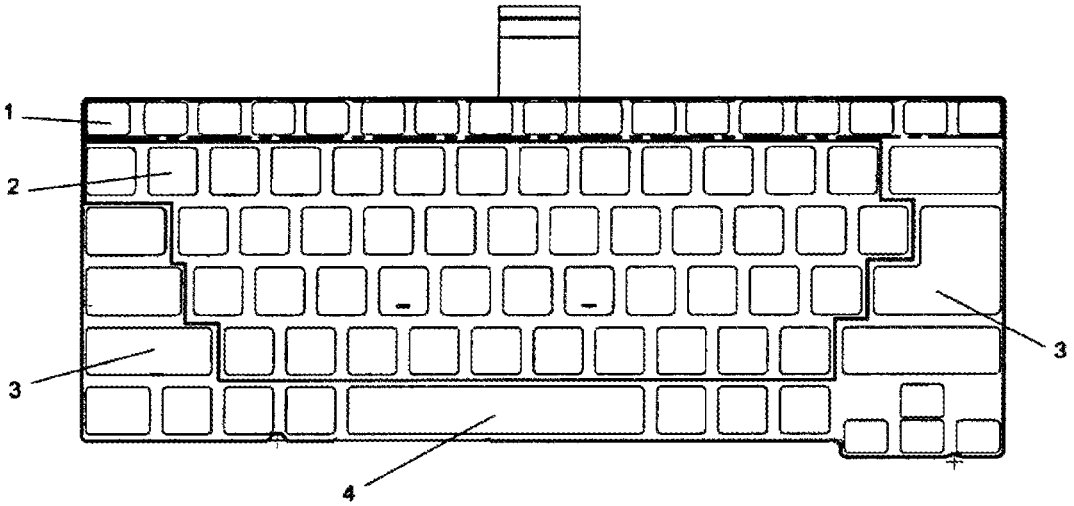
FIG. 5 is a schematic view of a keying portion region of a magnetic keyboard according to embodiment 3.

The magnetic keyboard comprises an F function key 1, standard 1X keys 2, special keys 3, and a space bar 4, as shown in FIG. 5.

Figure 6:
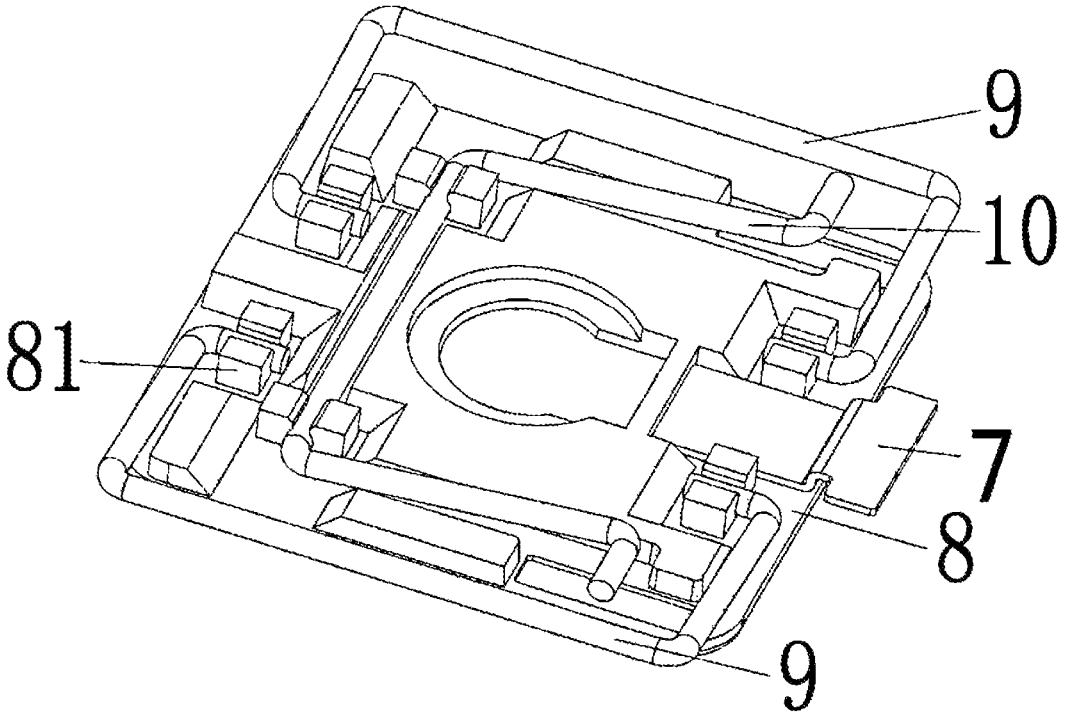
FIG. 6 is a schematic view of balance rods for a standard 1X key of the magnetic keyboard according to embodiment 3.

Each standard 1X key 2 has two balance rods 9 running in the direction of X-axis of the keying portion and one balance rod 10 running in the direction of Y-axis of the keying portion, that is, three balance rods in total. The three balance rods neither cross nor overlap, as shown in FIG. 6.

Figure 7:
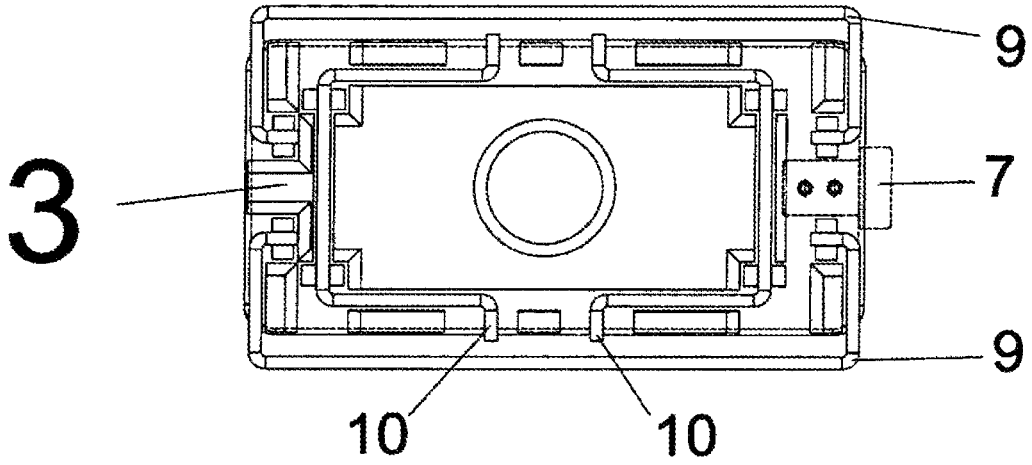
FIG. 7 is a schematic view of balance rods for special key of the magnetic keyboard according to embodiment 3.

The special keys 3 include SHIFT key, CapsLock key, Tab key, Backspace key and the like. Each special key 3 has two balance rods 9 running in the direction of X-axis of the keying portion and two balance rods 10 running in the direction of Y-axis of the keying portion, that is, four balance rods in total. The four balance rods neither cross nor overlap, as shown in FIG. 7.

Figure 8:
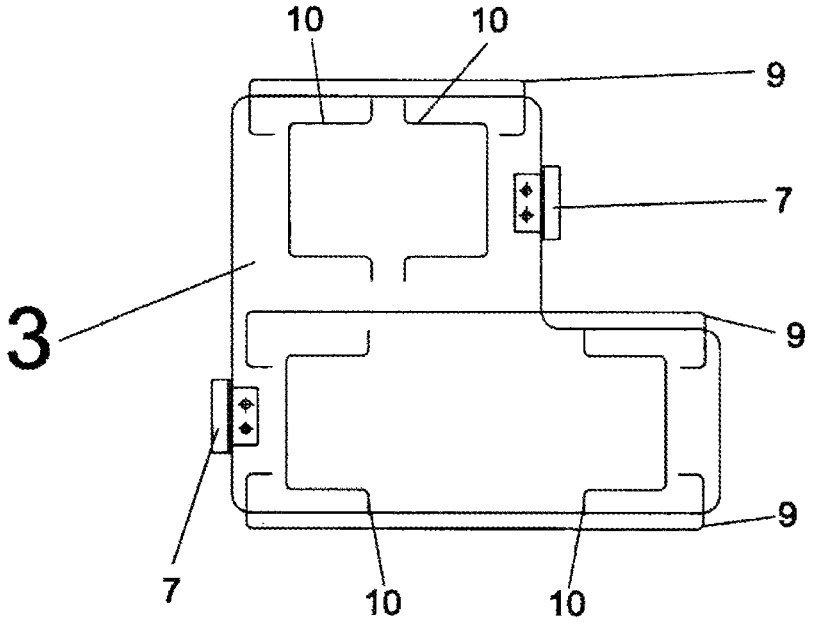
FIG. 8 is a schematic view of balance rods for a special key—an Enter key of the magnetic keyboard according to embodiment 3.

An Enter key 3, one of the special keys 3, has three balance rods 9 running in the direction of X-axis of the keying portion and four balance rods 10 running in the direction of Y-axis of the keying portion, that is, seven balance rods in total. The seven balance rods neither cross nor overlap, as shown in FIG. 8.

Figure 9:
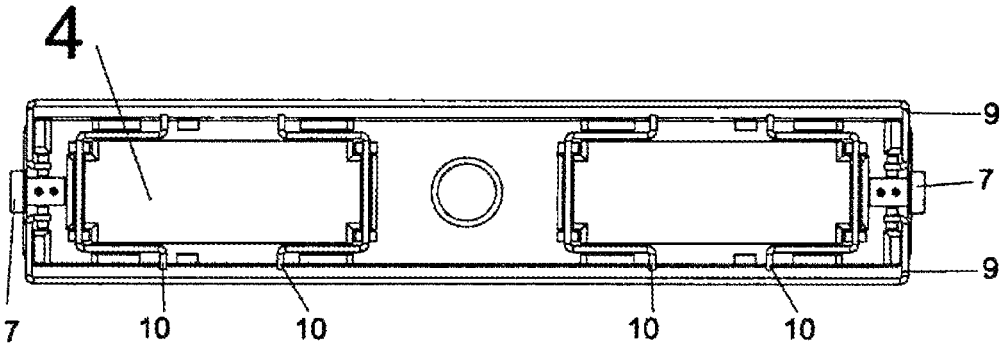
FIG. 9 is a schematic view of balance rods for a space bar of the magnetic keyboard according to embodiment 3.

The space bar 4 of the magnetic keyboard has two balance rods 9 running in the direction of X-axis of the keying portion and four balance rods 10 running in the direction of Y-axis of the keying portion, that is, six balance rods in total. The six balance rods neither cross nor overlap, as shown in FIG. 9.

Figure 10:
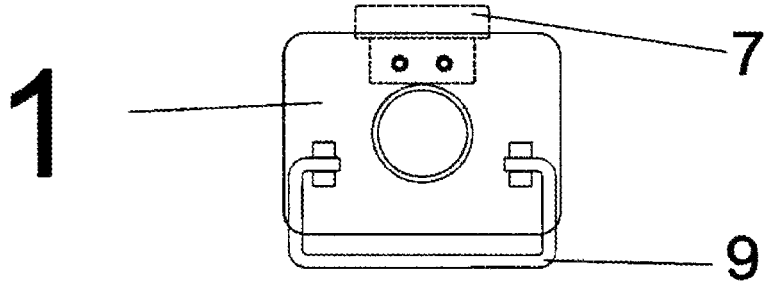
FIG. 10 is a schematic view of balance rods for an F function key of the magnetic keyboard according to embodiment 3.

The flat or narrow F function key 1 and UP, DOWN, LEFT, RIGHT keys of the magnetic keyboard have one balance rod 10 running in a flat direction of the keying portion, that is, one balance rod in total, as shown in FIG. 10.

The upper end of each balance rod is movably connected to the keying portion.

The lower end of each balance rod is movably connected to the intermediate plate or the base plate.

The balance rods are made of conventional stainless steel wires preferably of a diameter of 0.4-1.0 mm.

Preferably, the keying portion is made of a soft material, a rigid material, or a combination thereof and thus can be made very thin.

Preferably, the keying portion and an arm of the magnetized iron plate are integrated.

Preferably, the keying portion is made of a transparent material to facilitate light penetration.

Preferably, a balance rod structure is disposed on the lower surface of the keying portion.

Preferably, a balance rod structure is disposed on the lower surface in the vicinity of the key hole of the intermediate plate.

Preferably, a balance rod is disposed between the keying portion and the lower surface of the intermediate plate.

The present disclosure is described above with specific examples solely with a view to rendering the present disclosure comprehensible rather than restricting the present disclosure. Persons skilled in the art can draw inferences and make variations or changes to the present disclosure in accordance with the spirit thereof.

The aforesaid specific embodiments illustrate the objectives, technical features and advantages of the present disclosure. It is worth noting that the above detailed description is merely about specific embodiments of the present disclosure but is not intended to be restrictive of the present disclosure. All amendments, equivalent changes, and improvements made in the specific embodiments of the present disclosure without departing from the spirit and principle of the present disclosure shall fall within the claimed scope of the present disclosure.

What is claimed is:

1. A key with balance rods, comprising:

a base plate;

a sensing component optionally disposed on the base plate;

an intermediate plate optionally disposed above the sensing component and having a key hole penetrating upper and lower surfaces of the intermediate plate;

an elastomer disposed in the key hole of the intermediate plate;

a keying portion movably disposed in the key hole of the intermediate plate and abutting against the elastomer; and at least two balance rods disposed below the keying portion and each having a segment movably disposed at the keying portion, wherein one of the at least two balance rods has another segment connected to the intermediate plate, and another one of the at least two balance rods has another segment disposed at the intermediate plate or the base plate, with the at least two balance rods neither crossing nor overlapping.

2. The key with balance rods according to claim 1, wherein the elastomer is disposed on the sensing component or on a lower surface of the keying portion.

3. The key with balance rods according to claim 1, wherein the balance rods are movably connected to the keying portion, and the balance rods are movably connected to the intermediate plate or the base plate.

4. The key with balance rods according to claim 1, wherein the intermediate plate has a receiving chamber penetrating an upper surface and a lower surface of the intermediate plate, with a magnetic component disposed in the receiving chamber of the intermediate plate, a magnetized iron plate having an arm and a hand, the arm being disposed in the key hole of the intermediate plate, the arm having an end fixedly connected to a lower surface of the keying portion, the arm having another end extending to reach the magnetic component disposed in the receiving chamber of the intermediate plate and connect to the hand, the arm being made of a plastic material or a metallic material, and the hand being a magnetically permeable iron plate, wherein the magnetic component and the hand of the magnetized iron plate are attracted, and thereby attached, to each other whenever the arm is not pressed down under any external force.

5. The key with balance rods according to claim 1, wherein an arm of a magnetized iron plate has a through hole penetrating upper and lower surfaces of the arm.

6. The key with balance rods according to claim 1, further comprising a light guide plate disposed below the intermediate plate or below the sensing component.

7. The key with balance rods according to claim 1, wherein the keying portion is made of a soft material, a rigid material, or a combination thereof.

8. The key with balance rods according to claim 1, further comprising an upper cover which is disposed on the intermediate plate and has a through hole corresponding in position to the key hole.

9. A keyboard with balance rods, comprising the key with balance rods according to claim 1.

10. The keyboard with balance rods according to claim 9, wherein the base plate is integrally formed.

11. The keyboard with balance rods according to claim 9, wherein the sensing component is integrally formed.

12. The keyboard with balance rods according to claim 9, wherein the intermediate plate is integrally formed.

* * * * *